US008464612B2

(12) United States Patent
Chase

(10) Patent No.: US 8,464,612 B2
(45) Date of Patent: Jun. 18, 2013

(54) SURFACE PROTECTOR WHEN HAMMERING NAILS

(76) Inventor: Noel Edmonds Chase, Toronto (CA)

( * ) Notice: Subject to any disclaimer, the term of this patent is extended or adjusted under 35 U.S.C. 154(b) by 0 days.

(21) Appl. No.: 13/304,288

(22) Filed: Nov. 23, 2011

(65) Prior Publication Data

US 2013/0125711 A1 May 23, 2013

(51) Int. Cl.
*B25C 3/00* (2006.01)

(52) U.S. Cl.
USPC ..... 81/44

(58) Field of Classification Search
USPC ..... 81/44, 487, 20, 490
See application file for complete search history.

(56) References Cited

U.S. PATENT DOCUMENTS

| | | | | | |
|---|---|---|---|---|---|
| 337,905 | A * | 3/1886 | Wheelock | ..... | 81/44 |
| 2,799,860 | A * | 7/1957 | Myers | ..... | 81/44 |
| 4,079,765 | A * | 3/1978 | Hatayan | ..... | 81/44 |
| 4,493,353 | A * | 1/1985 | Thomas | ..... | 81/44 |
| 4,960,235 | A * | 10/1990 | Gregory | ..... | 81/44 |
| 6,520,050 | B1 * | 2/2003 | Gildroy | ..... | 81/44 |

* cited by examiner

*Primary Examiner* — Hadi Shakeri

(57) ABSTRACT

The manual nailing process can injure the person's hand gripping the nail when the nail head is missed. The underlying surface of the work (the object being nailed, made of wood or other relevant materials) can be damaged when the hammer hits the work surface instead of the nail or from the hammer claws when the nail is extracted. The nailing aid described in this application holds the nail when it is being started, away from the person's hand. This aid also provides protection for a broad area of the underlying work surface around the nail, when the nail is being struck or extracted. The striking surface of the aid is sloped to prevent it from being trapped by a bent nail or a nail head. The handle of this aid also serves as a holder for an optional nail set or pencil.

6 Claims, 1 Drawing Sheet

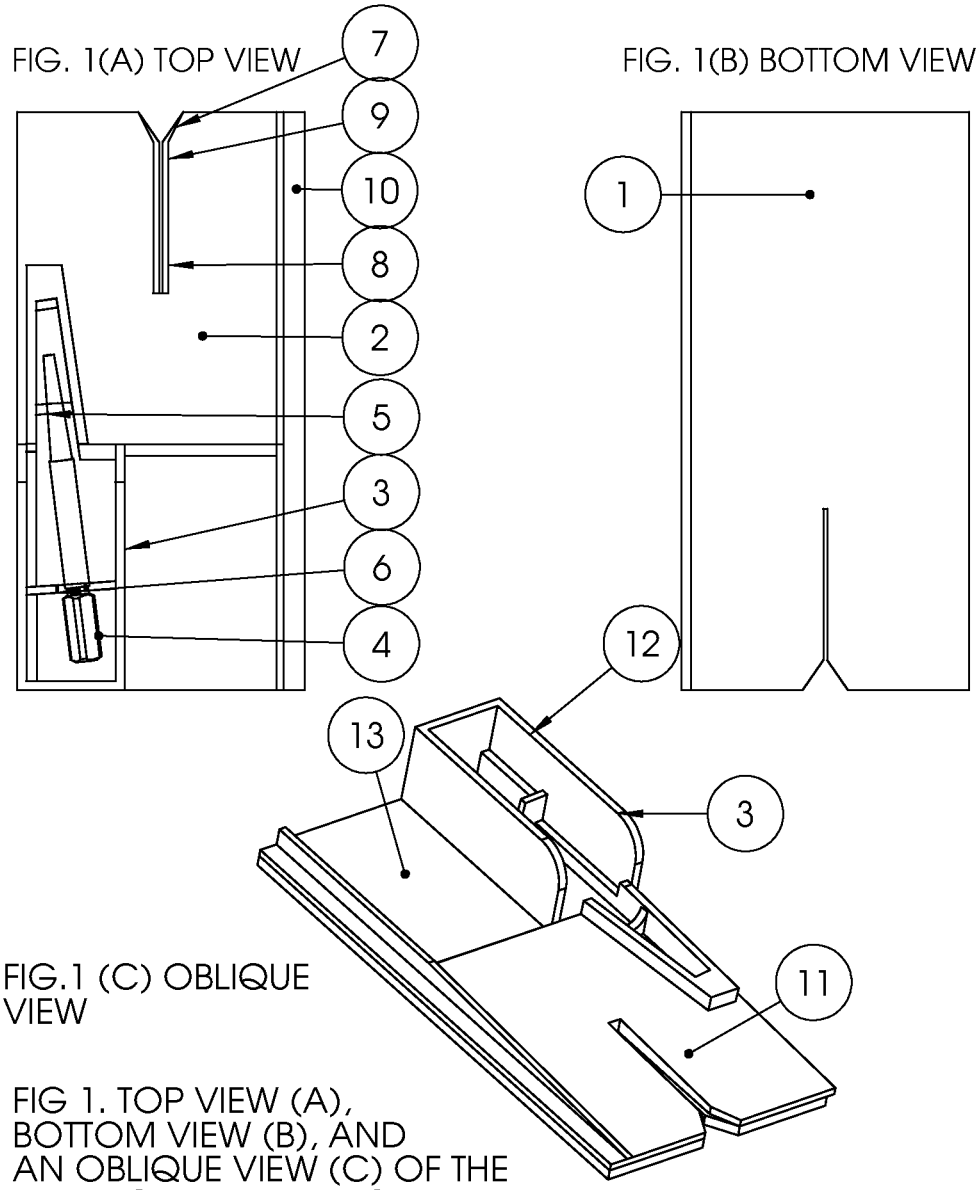
FIG 1. TOP VIEW (A), BOTTOM VIEW (B), AND AN OBLIQUE VIEW (C) OF THE NAILING AID INVENTION.

SURFACE PROTECTOR WHEN HAMMERING NAILS

CROSS-REFERENCE TO RELATED APPLICATIONS

No cross-reference is made to other applications.

STATEMENT REGARDING FEDERALLY SPONSORED RESEARCH OF DEVELOPMENT

No Federal Government support was received in the development of this Invention.

SEQUENCE LISTING, TABLE, OR COMPUTER PROGRAM LISTING

No sequence listing, table, or computer program is attached or accompanies this application.

PATENTOR

Noel Edmonds Chase is the Sole Inventor of this Utility.

BACKGROUND OF THIS INVENTION

A surface protector when hammering nails is essential for the preservation of valuable surfaces of the work (In this context, the work is defined as the object being nailed, typically made of wood or other relevant materials). Any extra functionality a surface protector can add to the nailing process will save valuable construction time. Three general trends in nail holding can be seen in an evolution of design leading to the Invention described in this application. These three trends are plier holders and vertical guides and rams. In a few inventions both nail striking and the nail pulling functions are provided. Only in this invention are these two functions integrated into one location. Considering that the nail that needs pulling is more often than not the nail that has just been struck it is advantageous to have the two functions available at the same spot yet important to neither compromise an unencumbered striking surface or the ability to extract nails.

The action of the nail-holding hand when nailing can be mimicked with pliers. Rion (US 2004/0035255: Feb. 26, 2004) describes a pair of pliers modified to hold various gauges of nail. Harris (U.S. Pat. No. 5,893,303: Apr. 13, 1999) had already patented a plier design that added a spring between the plier handles for ease of disengagement, and McIlvenna (US 2005/0051000: Mar. 10, 2005) describes a plier design that also has a spring but lacks a means of accommodating differing gauge of nails. All plier designs suffer from three shortcomings. The first shortcoming becomes apparent when the nail is misstruck across a plier blade. This can trap the plier blade. Although it is possible to lever up the nail this would gouge the work surface beneath. The second shortcoming is that striking at the nail may result in a striking on the plier blades themselves resulting in a painful capture of the fingers holding the pliers between the work surface and the handles. The third shortcoming is the inability to guide the nail in such that striking is still possible to the point where the gap remaining between the work surface and the nail head approximates the gauge of the nail itself. The disadvantage of having to extract the nail guide before reaching this gap is that the nail has plenty of opportunity to bend upon further striking.

This last disadvantage works against the utility of the vertical guide design school of nail holders. Peck (U.S. Pat. No. 4,784,025: Nov. 15, 1988) patented a variety of shoeing tool in which the nail simply sits in a cross-sectioned hole equipped with a handle. No accommodation for nail gauge is possible. Meitzler (US 2006/0101948: May 18, 2006) describes a similar vertical guide and Lee (U.S. Pat. No. 7,467,573: Dec. 23, 2008) dispenses with a handle altogether in favour of a pinch type hold. All three devices do not permit close nailing. All three devices make no provision for nail pulling. All three devices have the potential for marking of the wood if struck directly. It would seem that the sole purpose of these vertical guides is to protect fingers.

The ram approach to nailing guides consisting of impact upon the top end of a narrow barrel overlaying the nail suffers many disadvantages. There is limited means of accommodating different gauges of nail. It is difficult to avoid damage to the work surface since the barrel as seen in Stephens (US 2007/0051208: Mar. 8, 2007) is small and likely to damage the work surface just as high heeled shoes do damage to wooden boat decks. The ratio between force and surface area is too small to prevent damage to the work surface. Other variants of the barrel approach make some accommodation for protection as in Rafaeli (US 2007/0181630: Aug. 9, 2007) yet the terminal area of the guide hitting the work surface is still small with respect to the gauge of the nail. This is likely to cause damage to the work surface. More importantly the possibility of nail failure within the barrel itself leads to a high likelihood of the guide failing owing the presence of a bent or broken nail jammed within the barrel. The barrel approach also offers no means of nail pulling.

Some devices attempt to provide the functionality of nail striking and nail pulling on the same tool. Weber (US 2003/0222251: Dec. 4 2003) provides a convex curve slotted to hold apparently only one gauge of nail. The bottom of the tool head is flat against the work surface. The convex curve does provide a physical lever surface against which to engage the claws of a hammer. The location of the slot within this convex curve on the top of the tool presents a highly encumbered area for striking. This leads to a higher risk of bent nails since the hammer head will glance across the nail if the side of the hammer head hits the steep convex rise. Rieck (U.S. Pat. No. 5,284,070: Feb. 8, 1994) reverts to the vertical guide to drive nails. This design is improved by the provision of an additional slot that will allow for closer nailing once one or more nails have been driven partway into the wood using the vertical guides. This last design has many disadvantages that are educational. The first is that the device must be replaced for close nailing. The second is that there is no means of extracting the device in case of entrapment by bent nail or nails. Unlike the device suggested by Weber there is no physical lever seat for the hammer claw to engage against in the case of nail pulling. Finally there is no protection for the work surface in either the case of nail pulling or in the case of misstrike on the device itself.

The nailing aid in this Application offers a true aid through a plurality of functions which can be better appreciated in contrast with pre-existing patents and patent applications.

1. Protection of the Hand.

The Invention in this Application allows for protection of the hand by offering gripping in the form of a three dimensional handle without risk of compression on the fingers as in the pliers group of nail guide designs.

2. Close Nailing.

Nailing down to a gap approximating the nail gauge between the work surface and the nail head is made possible through the slim profile of the nail grip feature. This allows for safe flush nailing using a nail set that is conveniently stored within the tool handle. This is in contrast to the majority of vertical guides which only allow for partial striking in of the nail owing to the height of the vertical channel. Those guides can be removed for further striking of the nail but the remaining gap is so great that the chance of a bent nail is correspondingly great.

3. Nail Holding.

The two layer design of the striking surface allows for a nail to be inserted in the bifurcated slit such that the shock absorbing material of the lower layer grips to the nail shaft and the slightly wider confines of the slot in the hard plastic layer above work to keep the nail perpendicular to the work surface being nailed. None of the guides described above allows for variation in nail gauge within the limits of the slot.

4. Tool Withdrawal.

Should the nail be misstruck the slight ramp on the striking surface of the tool allows for the nailing aid to be worked free. Otherwise the tool would be nailed to the work surface as would be the case for the Inventions described in the majority of existing patents.

5. Nail Pulling.

If a nail is misstruck and needs to be pulled the claws of the hammer can lever up the ramp of the striking surface and then engage against the recessed flat upper surface of the tool for good leverage. Novelty arises in the integration of an unencumbered striking surface with a device for engaging the hammer claws.

6. Work Surface Protection.

Either through misstriking directly on the nailing aid or while pulling out a nail with the hammer the underlying shock absorbing material provides protection against damage to the work surface.

7. Broad Striking Surface:

The invention offers an unrestricted striking surface for easy nailing.

Some of these features are novel unto themselves but the integration of features into a nailing aid that allows for easy nailing and easy extraction whilst protecting the hands and the work surface contribute to the Claims to novelty of this Invention.

BRIEF SUMMARY OF THE INVENTION

The Invention described in this application is a nearly flat two layer assembly for use in nailing work surface. The lower layer is shock absorbing material with a slot matching a slightly wider slot in the upper hard plastic layer. The upper surface of the hard plastic layer is configured to provide a number of functions including:

1. Protection of the hand.
2. Close nailing.
3. Nail holding.
4. Tool withdrawal.
5. Nail pulling.
6. Work surface protection.
7. Broad striking surface.

BRIEF DESCRIPTION OF THE SEVERAL VIEWS OF THE DRAWING

The drawings illustrate the best mode presently contemplated of carrying out the Invention.

In the drawings:

FIG. 1(*a*) is a top plan view showing the nail set holder and bifurcated nail holder.

FIG. 1(*b*) is a bottom plan view showing the shock absorbing pad.

FIG. 1(*c*) is an isometric perspective view showing the sloped nailing surface.

DETAILED DESCRIPTION OF THIS INVENTION

A top view of the device appears in FIG. 1(*a*). A thin flat pad of shock absorbing material (1) as seen in the bottom view in FIG. 1(*b*) is affixed to a hard plastic body (2) as seen if FIG. 1(*a*). A raised open box (3) holds one or more nail sets (4) by means of clip recesses (5) and (6) holding the nail set end and the base of the nail set respectively. The nailing area of the Invention is partially bifurcated (7) to allow for the holding of the nail by the slit (8) in the shock absorbing material below extending under the slit (9). Note that the width of the slit (9) in the hard plastic top (2) is wider than the parallel slit (8) in the shock absorbing material below to provide for a flexible grip on the nail. An offset feature or plurality of offset features (10) are used in aligning one wooden strip to the edge of another as when installing trim around a door frame. The nailing area (2) protects the work surface by means of the underlying shock absorbing pad that absorbs a misplaced blow from the hammer hitting the nailing area. Should the nail bend under impact the hitting area is sloped toward the edge to allow the Invention to be extracted.

Also illustrated in FIG. 1 are three other functionalities of the nailing aid. As seen in FIG. 1(*c*) a raised open box (12) also serves as a handle for the device to be positioned with the free hand as well as being a holder for an optional nail set. The slightly recessed area (13) adjacent to the inclined nailing ramp (11) is used when pulling a nail out through provision of a place to lever the claws of the hammer against without damaging the work surface underneath the Invention. The slightly recessed area (13) provides protection from the head of the hammer as the nail is being pulled out. The shock absorbing pad (1) provides for protection of the work surface being nailed. The ramp itself in the nailing ramp (11) provides a means for removing the Invention if a nail is hammered bent and traps the Invention. The ramp allows the person nailing to work the Invention free.

The overall functionalities of the nailing aid are to serve in place of the non-nailing hand when nailing to avoid injury as well as to protect the work surface when both nailing and extracting nails. The ability to extract the Invention when a nail bends is afforded by the ramped design. The convenience of having an optional nail set is added to by the convenience afforded using the same holder as a handle.

The invention claimed is:

1. A device for holding nails and for protecting a surface when hammering or pulling nails comprising:

a body comprising a top surface and a bottom surface, the top surface including an inclined nailing ramp at one end and an adjoining flat upper surface at another end opposite the one end;

a slit provided in the inclined nailing ramp;

an underlying shock absorbing pad provided on the bottom surface of the body;

a hand grip defined by a raised box for storing one or more items; and means for securely holding the one or more items within the hand grip.

2. The device of claim 1, wherein the body is made of hard plastic.

3. The device of claim 1, wherein said flat upper surface is recessed.

4. The device of claim 1, wherein said slit comprises of a slit formed in the underlying shock absorbing pad and a wider slit formed in the inclined nailing ramp.

5. The device of claim 1, wherein said one or more items comprises a nail set or a pencil.

6. The device of claim 1, wherein said holding means comprises clip recesses.

* * * * *